US009757601B2

(12) United States Patent
Lenz, Jr. et al.

(10) Patent No.: US 9,757,601 B2
(45) Date of Patent: Sep. 12, 2017

(54) FIREFIGHTING OR RESCUE APPARATUS INCLUDING A LADDER MOUNTED RECOVERY WINCH

(71) Applicant: HME, Incorporated, Wyoming, MI (US)

(72) Inventors: Kenneth C. Lenz, Jr., Hudsonville, MI (US); Richard R. Lagerquist, Plainwell, MI (US)

(73) Assignee: HME, Inc., Wyoming, MI (US)

( * ) Notice: Subject to any disclaimer, the term of this patent is extended or adjusted under 35 U.S.C. 154(b) by 133 days.

(21) Appl. No.: 14/669,816

(22) Filed: Mar. 26, 2015

(65) Prior Publication Data

US 2015/0273252 A1 Oct. 1, 2015

Related U.S. Application Data

(60) Provisional application No. 61/973,501, filed on Apr. 1, 2014.

(51) Int. Cl.
*A62C 27/00* (2006.01)

(52) U.S. Cl.
CPC ..... *A62C 27/00* (2013.01)

(58) Field of Classification Search
CPC ..... A62C 27/00; A62C 25/00; A62C 31/00; A72C 37/00; E06C 7/12; B66F 19/00
See application file for complete search history.

(56) References Cited

U.S. PATENT DOCUMENTS

| | | | | |
|---|---|---|---|---|
| 14,891 A | | 5/1856 | Amringe | |
| 197,324 A | | 11/1877 | Boynton | |
| 202,263 A | | 4/1878 | James | |
| 283,654 A | | 8/1883 | Peteler | |
| 440,827 A | | 11/1890 | Hoffman | |
| 589,244 A | | 8/1897 | Cantore | |
| 2,249,900 A | * | 7/1941 | Honig | A62B 1/02 182/103 |
| 2,312,833 A | * | 3/1943 | Graham | A62B 1/02 182/102 |
| 2,459,621 A | * | 1/1949 | Cobb | E06C 7/12 182/102 |
| 2,551,036 A | * | 5/1951 | Mills | A63H 17/08 182/66.1 |

(Continued)

FOREIGN PATENT DOCUMENTS

WO 03000345 1/2003

*Primary Examiner* — Alvin Chin-Shue
*Assistant Examiner* — Shiref Mekhaeil
(74) *Attorney, Agent, or Firm* — Warner Norcross & Judd LLP

(57) ABSTRACT

A firefighting or rescue apparatus includes a ladder to which a recovery winch is operably mounted so that the winch can be used to move, upright, lift or otherwise manipulate target objects at an emergency location. The ladder can include a pulley detachably mounted to the ladder distal from the winch, the pulley adapted to suspend a cable extending from the winch at an upper end. In operation, the winch moves along with the ladder as the ladder moves, so that the winch and pulley can be strategically located over a target object for movement thereof. The apparatus can include a remote control connected to the winch for operation of the winch by a user.

10 Claims, 8 Drawing Sheets

(56) References Cited

U.S. PATENT DOCUMENTS 2,628,071 A * 2/1953 Williams ..... B66D 3/04 182/129
2,786,583 A * 3/1957 Garrison ..... B66C 23/36 212/247
3,048,371 A * 8/1962 Klimek, Jr. ..... B66C 23/36 212/180
3,059,781 A * 10/1962 Bender ..... B66C 23/36 180/330
3,675,721 A * 7/1972 Davidson ..... F16L 27/125 169/24
3,693,755 A * 9/1972 Terayama ..... E06C 5/36 182/102
4,059,170 A * 11/1977 Young ..... A62C 27/00 180/54.1
4,183,423 A * 1/1980 Lewis ..... E06C 7/12 182/103
4,396,093 A * 8/1983 Zimmerman ..... E06C 5/04 182/2.11
4,410,045 A * 10/1983 Whitman ..... A62C 31/24 169/24
4,436,180 A * 3/1984 Nilsson ..... B63B 27/14 114/368
4,487,544 A * 12/1984 Hubbard ..... B60P 3/125 280/402
4,550,804 A * 11/1985 Bummer ..... A62B 1/12 182/10
4,598,795 A * 7/1986 Larson ..... E06C 7/48 182/129
4,650,035 A * 3/1987 Eubanks ..... E06C 7/12 182/101
4,697,740 A 10/1987 Ivy
4,706,779 A * 11/1987 Bono ..... B66B 9/16 182/103
4,802,535 A 2/1989 Bakke
4,930,599 A 6/1990 Simms, Sr.
5,139,108 A * 8/1992 Pate ..... E06C 7/48 182/108
5,279,389 A * 1/1994 Crockett ..... E06C 7/48 182/129
5,316,265 A * 5/1994 Welch ..... B66C 23/203 212/179
5,409,067 A 4/1995 Esposito et al.
5,540,284 A 7/1996 Esposito et al.
5,738,185 A * 4/1998 Sears ..... E06C 7/48 182/102
5,832,755 A 11/1998 Crilly
5,911,287 A * 6/1999 Campbell ..... E06C 7/48 182/103
5,913,367 A 6/1999 Hampton
6,193,170 B1 2/2001 Fitzgerald
6,244,381 B1 * 6/2001 Ruble ..... B66B 9/187 182/103
6,298,945 B1 * 10/2001 Anders ..... A62C 99/00 169/70
6,390,235 B1 5/2002 Tsay
6,454,049 B1 * 9/2002 Dorsett ..... E06C 7/12 182/102
6,782,972 B1 * 8/2004 Hatch ..... E04D 15/00 182/102
6,840,330 B2 1/2005 Lancaster
7,033,128 B2 * 4/2006 Poindexter ..... B60P 1/4414 414/522
8,083,047 B1 * 12/2011 Hermann ..... B65G 21/14 198/313
8,413,764 B1 * 4/2013 Cohen ..... E06C 7/18 182/62.5
8,540,547 B2 * 9/2013 Ibarra ..... A63H 17/05 446/426
2002/0079163 A1 * 6/2002 Figura ..... E06C 5/04 182/2.5
2003/0019689 A1 * 1/2003 Dorsett ..... E06C 7/12 182/129
2007/0267250 A1 * 11/2007 Wolff ..... E06C 7/081 182/103
2008/0060822 A1 * 3/2008 Salmi ..... A62C 27/00 169/24
2013/0031841 A1 2/2013 Naranjo
2013/0068559 A1 * 3/2013 Grado ..... E06C 7/12 182/102
2013/0095968 A1 * 4/2013 Stephenson ..... B66D 1/7405 474/137
2015/0226002 A1 * 8/2015 Johansen ..... E06C 9/02 182/217
2015/0298948 A1 * 10/2015 Jackson ..... B66F 11/046 182/2.2

* cited by examiner

FIREFIGHTING OR RESCUE APPARATUS INCLUDING A LADDER MOUNTED RECOVERY WINCH

BACKGROUND OF THE INVENTION

The present invention relates to a firefighting apparatus, such as a fire truck, a trailer or other vehicles, and more particularly to a firefighting apparatus with a ladder mounted recovery winch.

There are a variety of fire trucks and rescue vehicles that include aerial ladders to assist in the fighting of fires. These aerial ladders usually are mounted on a frame or chassis of a fire truck. The ladder can be raised from a generally horizontal position to an angled position so that the ladder extends updwardly from the frame. The ladder can be extended and retracted to achieve varying heights for rescue operations and/or for the application of firefighting fluids.

Generally, aerial ladder trucks are used to fight fires from elevated positions or to rescue victims trapped in burning buildings. Some aerial ladder trucks also can be outfitted with a roof ventilating lance that is operably coupled to a cable. The lance can be dropped with a system of pulleys to ventilate a roof of a burning building. Such a roof ventilating lance is disclosed in U.S. Pat. No. 6,298,945 to Anders, which is hereby incorporated by reference. Although this construction allows roof ventilation, it is not suitable for many other operations.

Occasionally, aerial ladder trucks are the first on the scene at an emergency location, such as the location of a traffic accident, a boating accident, a plane accident, a man-made or natural disaster, and/or a terrorist attack, where large objects and their orientations impede the rescue or application of care to victims. While aerial ladder trucks can provide their typical support at the emergency location, such as elevated fire suppression and/or providing an evacuation or rescue "bridge," such trucks are not well suited for other types of recovery and/or rescue operations.

Thus, while aerial ladder trucks are currently available and helpful in a variety of situations, there remains room for improvement in their function, operation and utilization.

SUMMARY OF THE INVENTION

A firefighting or rescue apparatus including a ladder to which a recovery winch is operably mounted is provided. The winch can be used in conjunction with the ladder to move, upright, lift or otherwise manipulate objects at an emergency location. As but one example, where an aerial ladder fire truck is dispatched to an emergency location, such as a traffic accident, the ladder and recovery winch can be utilized to move or upright overturned vehicles. This can enable first responders to quickly provide care to and/or to rescue occupants of the vehicles—even when a tow truck is not yet at the emergency location.

In one embodiment, the winch is mounted to a base section of an extendable ladder, which includes one or more retractable and extendable ladder sections. The base can be in the form of a boom joined with a turntable rotatably mounted on the firefighting or rescue apparatus.

In another embodiment, a ladder section, for example the fly section, can include a pulley detachably mounted to the ladder distal from the winch. The pulley can be located generally above the winch when the ladder is oriented in a raised, non-horizontal position. The pulley can suspend a cable, extending from the winch, so that the cable further extends downward, generally vertically from the pulley. An attachment element can be secured to the end of the cable. The attachment element can be in the form of a hook, clamp, tongs or other apparatus attachable to a target object to enable a force to be transmitted from the cable and through the attachment element to move the object.

In yet another embodiment, the pulley can be detachably mounted to the ladder so that after performing an operation with the winch, the pulley can be removed, and the ladder can be lowered to a generally horizontal stored position without the pulley interfering with or damaging a cab of the firefighting apparatus, over which a portion of the ladder is positioned.

In even another embodiment, the firefighting apparatus can be in the form of a fire truck, including a cab, a forward portion, a rearward portion and opening sides. The winch can be mounted to the base or boom in a location so that when the ladder is in the generally horizontal stored mode, the winch is immediately rearward of the cab. In this location, the winch can be generally out of the way, so that it does not interfere with the lowering of the ladder to the generally horizontal stored mode.

In a further embodiment, the ladder, frame of the apparatus and/or winch can include a control in communication with the winch for its operation, for example, uptake of cable onto the spool of the winch, or let out of the cable from the spool.

In even a further embodiment, the control can be a remote control that is remote from the winch. The remote control can be coupled to at least one of the frame of the apparatus and the winch with a cord having a length that enables a user to operate the remote control while in plain view of the object to be moved. Alternatively, the remote control can operate and communicate with the winch wirelessly, utilizing radio frequency, infrared, cellular or other communication modes.

In still a further embodiment, the winch can be mounted to the underside of the base section and/or boom, distal from a turntable to which the base section and/or boom are attached. Due to this fixed mounting to the base section and/or boom, the winch generally moves wherever the ladder moves. Optionally, when mounted to the ladder, the detachable pulley also moves with the ladder. Accordingly, the winch and pulley are positioned automatically with the ladder when the ladder is oriented in a desired configuration relative to a target object to be moved using the winch.

The present invention provides a simple and effective construction that can enable a firefighting or rescue apparatus, such as a fire truck, to serve multiple functions. Where an aerial firefighting apparatus is dispatched to an emergency location, which does not necessarily require an aerial ladder, the recovery winch and ladder herein can be used to move extremely heavy objects at the scene. In cases where vehicles, trucks, boats or other objects are overturned or otherwise obstructing the rescue of victims or impairing provision of care, the ladder and winch can be used to move those objects. Likewise, where heavy debris or other structures impair access to victims or structures, the recovery winch and system can be used to move those objects—even well before a tow truck arrives at the location.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
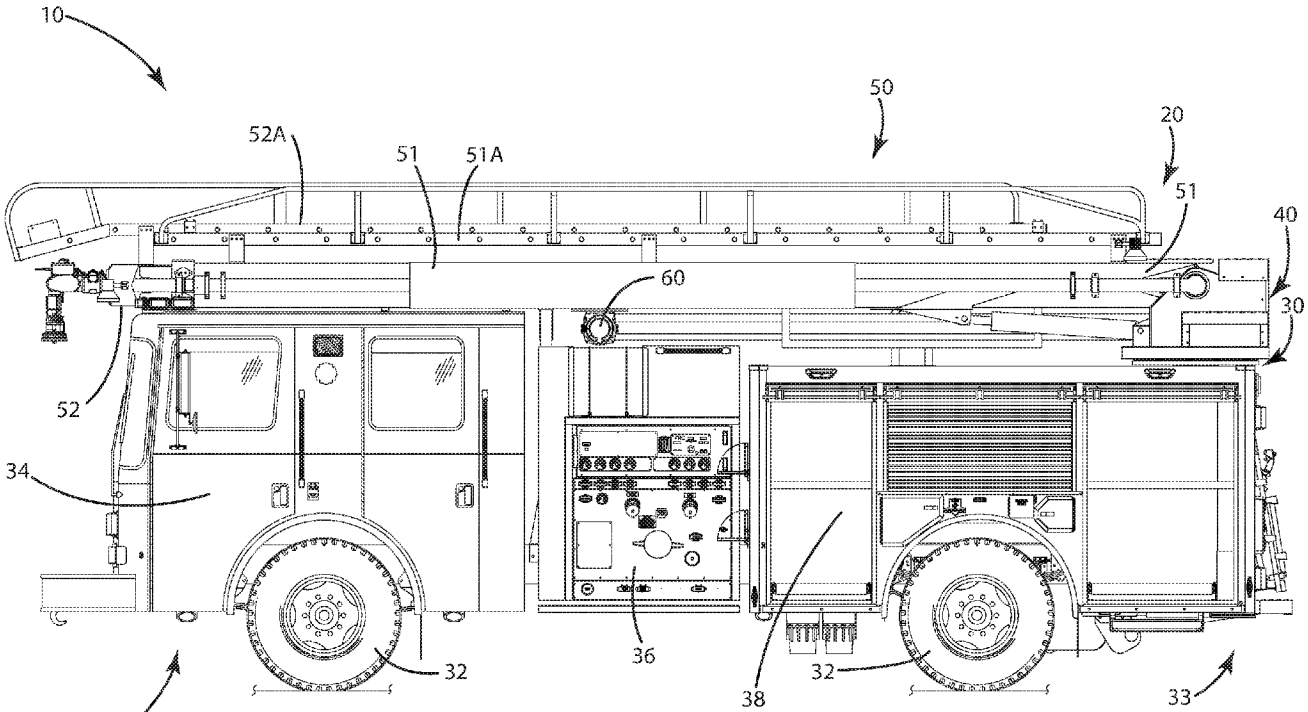
FIG. 1 is a side view of an aerial firefighting or rescue apparatus in the form of a fire truck including a recovery winch mounted thereto, according to a current embodiment.

A current embodiment of an aerial firefighting apparatus is illustrated in FIGS. 1-10 and generally designated 10. As shown there, the aerial firefighting apparatus is in the form of an aerial ladder fire truck. Although referred to as an aerial firefighting apparatus, as used herein, that term can also include a variety of emergency vehicles, rescue vehicles and other modes of transportation such as aerial ladder trailers or other equipment. Generally, the aerial ladder apparatus, referred to herein as a fire truck, can be a self-propelled vehicle including a ladder 50. The ladder can be mounted on a frame 30 of the fire truck via a rotatable turntable 40.

The frame 30 of the fire truck 10 can be mounted to a chassis which can be further mounted to multiple wheels 32. The wheels can be attached to conventional front and rear axles, which are further attached to the chassis of the truck. The fire truck can be mobilized via an internal combustion engine which drives the wheels via a transmission.

The fire truck 10 can include one or more internal electronic or computer controls that can operate the engine, transmission, or steering control mechanism to enable the front wheels to be steered upon transport to an emergency location. As used herein, an emergency location can be a scene of a traffic accident, a boating accident, a plane accident, a man-made or natural disaster, and/or a terrorist attack, or any other location where one or more victims' lives are endangered or otherwise compromised.

The frame 30 can include a forward portion 31 and a rearward portion 33 located at opposite ends of the fire truck 10. Generally the rear wheels 32 and their axle are located in the rearward portion 33 of the fire truck 10. The front or steering wheels 32 can be located in the forward portion 31 of the fire truck. The frame 30 in the forward portion 31 can include a cab 34. The cab 34 can house occupants, such as firefighters or rescue personnel, as they are transported to and from an emergency location. The cab 34 can include conventional controls, such as a steering mechanism and various displays inside the cab to monitor and evaluate the operation of the vehicle 10. The cab can terminates a distance of several feet rearward of the front wheels 32, or generally forward of the pump controls and/or rearward portion 33 of the fire truck 10.

On the frame, behind the cab 34 a pump control panel 36 can be mounted. Under or behind the pump control panel 36, one or more pumps (not shown) can be mounted. These pumps can be mounted to the frame. Generally, the pumps can be in fluid communication with a firefighting fluid tank (not shown) mounted to the frame in the rearward portion 33 and/or a source of firefighting fluid external to the truck, such as a fire hydrant. The pumps also can be in fluid communication with one or more hoses or waterways 47 as described below. The pumps can be configured to convey firefighting fluid from the external source or the tank to the waterways 47 in a forced manner so that the firefighting fluid can be applied to a fire.

The frame 30 also can include lockers 38 mounted rearward of the pump control panel 36, generally in the rearward portion 33 of the fire truck 10. The lockers optionally can be located on and accessible from the first 35A and second 35B sides of the fire truck, and can be sized and configured to store supplies and equipment useful for easy access at an emergency location.

Figure 2:
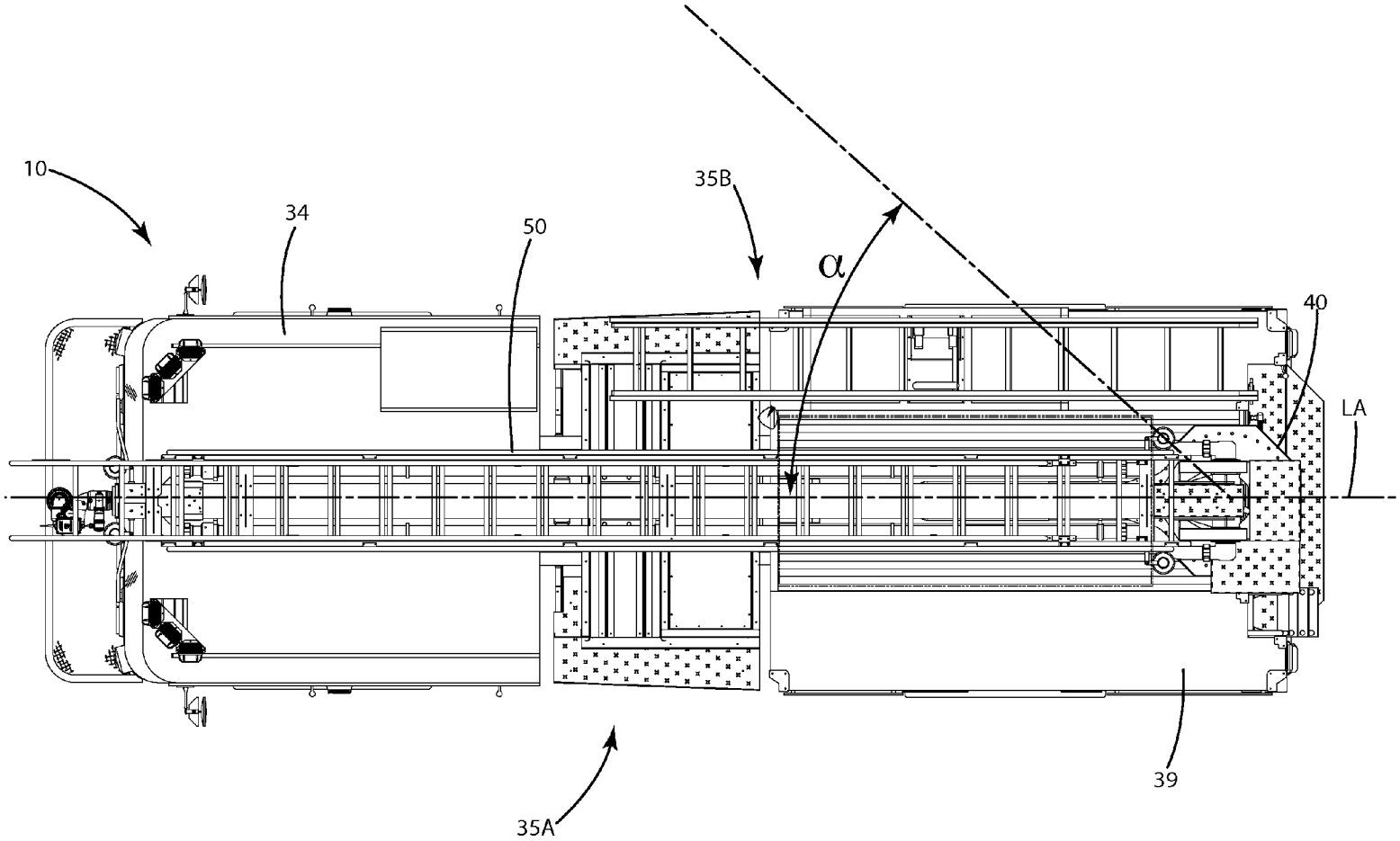
FIG. 2 is a top view of the aerial firefighting apparatus.
Figure 3:
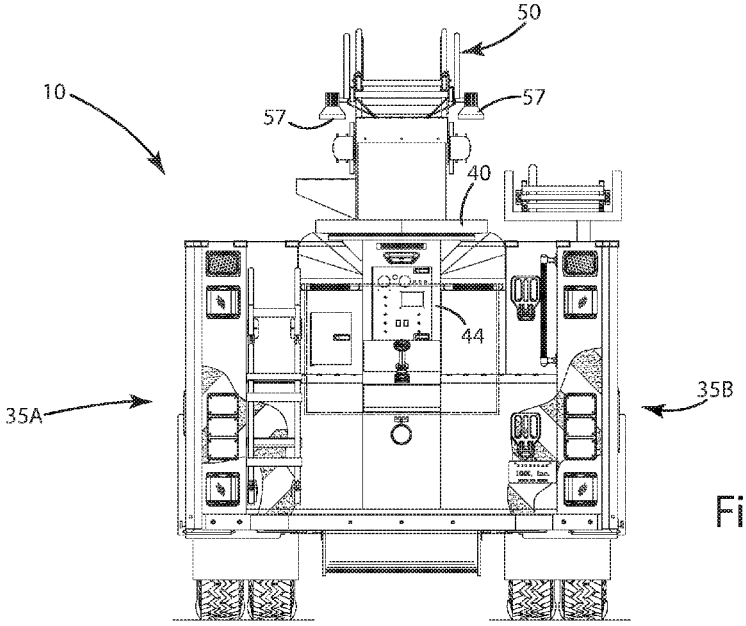
FIG. 3 is a rear view of the aerial firefighting apparatus.
Figure 4:
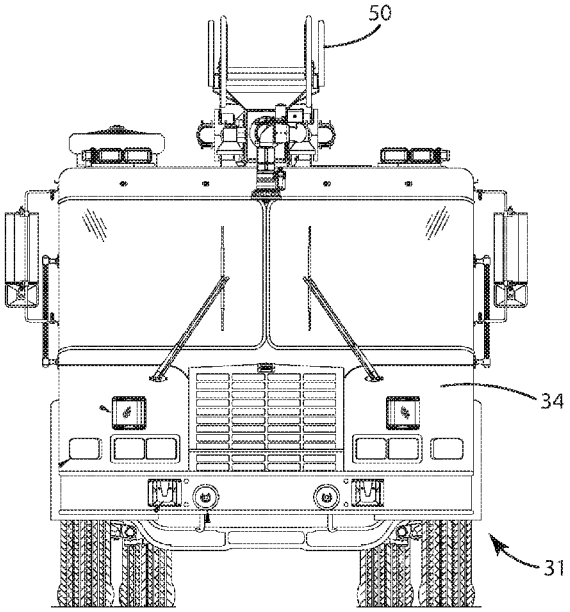
FIG. 4 is a front view of the aerial firefighting apparatus.

As shown in FIGS. 1, 3 and 4, the fire truck and frame 30 also can include an upper deck 39 on which the aerial ladder 50 is mounted. The aerial ladder 50 can be mounted directly to the turntable 40, which is rotatably mounted to the upper deck and/or frame. The turntable can be configured to pivot or rotate the ladder 50 and its sections to a predetermined angle a relative to the longitudinal axis LA of the truck 10, as shown in FIG. 2. Generally, the turntable 40 enables the ladder 50, when raised from a generally horizontal stored position, to pivot through a variety of different orientations relative to the longitudinal axis LA of the truck. The turntable 40 can include its own controls 44 accessible from the rear of the truck. The controls 44 can enable an operator to control the rotation or pivoting of the turntable 40 throughout a range of angles relative to the longitudinal axis LA, and optionally the extension and retraction of the ladder 50, the raising and lowering of the ladder 50, as well as various lighting elements 57 associated with the ladder.

As mentioned above, the frame 30 can include a first side 35A and a second side 35B located opposite one another. Generally, the turntable 40 can rotate the ladder 50, optionally when it is out of its generally horizontal stored position, outward beyond one of the sides 35A or 35B and at an angle transverse to the longitudinal axis LA.

Figure 5:
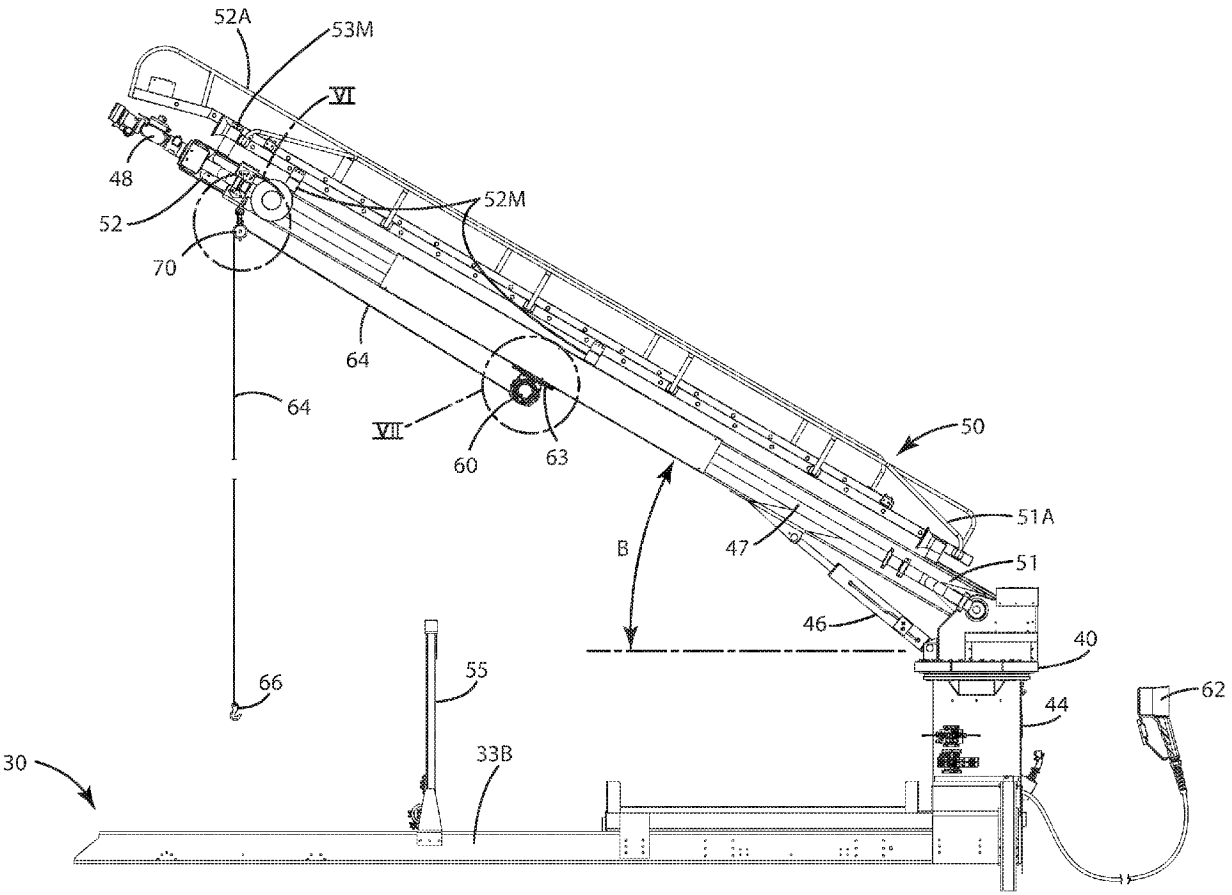
FIG. 5 is a side view of the aerial firefighting apparatus, with the cab, chassis and other elements removed therefrom, with the ladder raised and the winch with its cable extended for a lifting operation.
Figure 11:
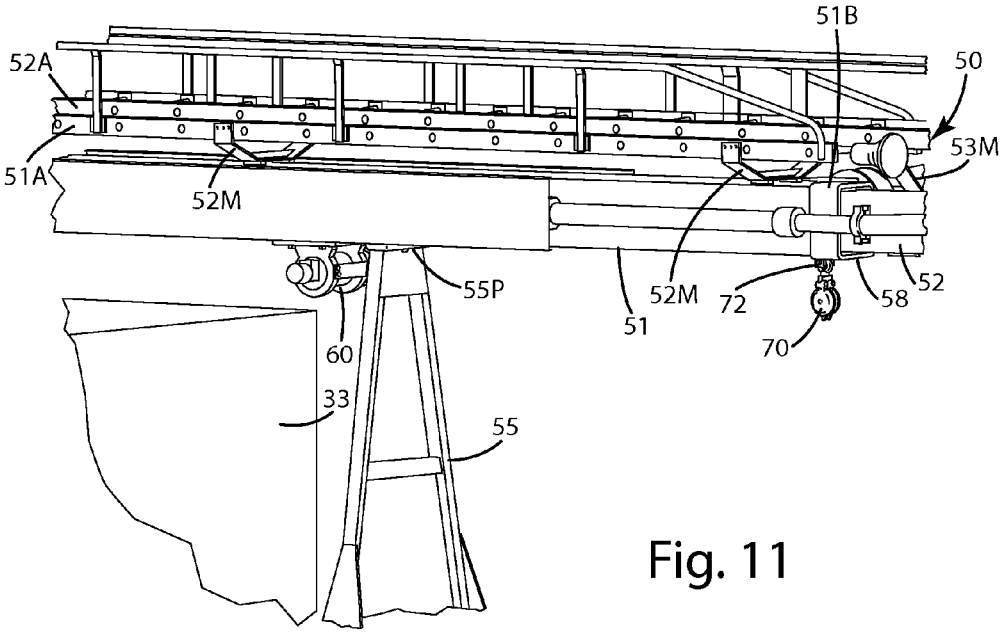
FIG. 11 is a perspective view of the winch and pulley mounted to the ladder in a generally horizontal stored mode.

The ladder 50 can include multiple ladder sections and booms that can be extended and retracted, and/or raised and lowered. As shown in FIGS. 1, 5 and 11, the ladder 50 can include a first base or boom 51, a first ladder section 51A attached to it, a second base or boom (sometimes referred to as a fly boom) 52, and a second ladder section 52A attached to it. Of course, although two ladder sections are illustrated, any number of booms or ladder sections can be utilized. Further, the arrangement and connection of the various ladder portions to one another can be varied depending on the application.

The booms and ladder sections can be movably joined with one another so that the entire ladder 50 can be extended and retracted by moving the booms 51, 52 and respective ladder sections 51A and 52A relative to one another. As an example, the first base or base boom 51 is movably and telescopingly joined with the second base (or fly boom) 52. The fly boom is generally fixedly joined with the second ladder section 52A so that the fly boom and the ladder section 52A move together, with the ladder section 52A supported by the fly boom. The first ladder section 51A can be fixedly joined with the base boom 51, so that the two move together. Generally, the first ladder section 51A and second ladder section 52A can be placed adjacent one another so that they also telescope and/or move relative to one another, optionally when the fly boom moves relative to the base boom.

Further optionally, the second ladder section 52A moves with the fly boom 52 and relative to the first ladder section upon extension of the ladder. The fly boom 52 also can retract into (or on) the base boom, with the second section overlapping the first ladder section more in the process. Even further optionally, the ladder sections can be coupled to one another so that as the ladder 50 generally extends, the ladder section 52A moves relative to section 51A and optionally relative to the base boom 51.

As illustrated, the base section 51, also referred to as base or boom, can be fixedly and pivotally mounted to the turntable 40. The base boom 51 can pivot up and down about an axis that is generally horizontal. As shown in FIGS. 1 and 5, the ladder can be raised and lowered under the power of a ladder raising and lowering mechanism 46. This mechanism 46 can be mounted between the turntable 40 and the ladder 50, optionally directly mounted to the base boom 51. The mechanism 46 can be in the form of one or more hydraulic rams in fluid communication with a source of pressurized fluid that is operable to raise and lower the ladder 50 from the generally horizontal stored position shown in FIGS. 1 and 11 to the raised position shown in FIGS. 5 and 8. The ladder can be extended, and in particular base and fly booms can be extended relative to one another, via utilization of other hydraulic rams (not shown) that operatively connect them. The turntable 40 also can be in communication with the source of pressurized fluid so that the turntable and aerial ladder can be rotated under hydraulic force, as shown in FIG. 2, to extend out one or more sides of the truck 10. Of course, other non-hydraulic mechanisms can be used to move the ladder and its components, such as electric motors, pneumatic mechanisms, or others depending on the application. Generally, the ladder raising and lowering mechanism 46 and the turntable 40 can be cooperatively operated to lift and rotate the ladder 50 out of a generally horizontal stored position to a variety of other operative positions and angles, and vice-versa.

Figure 10:
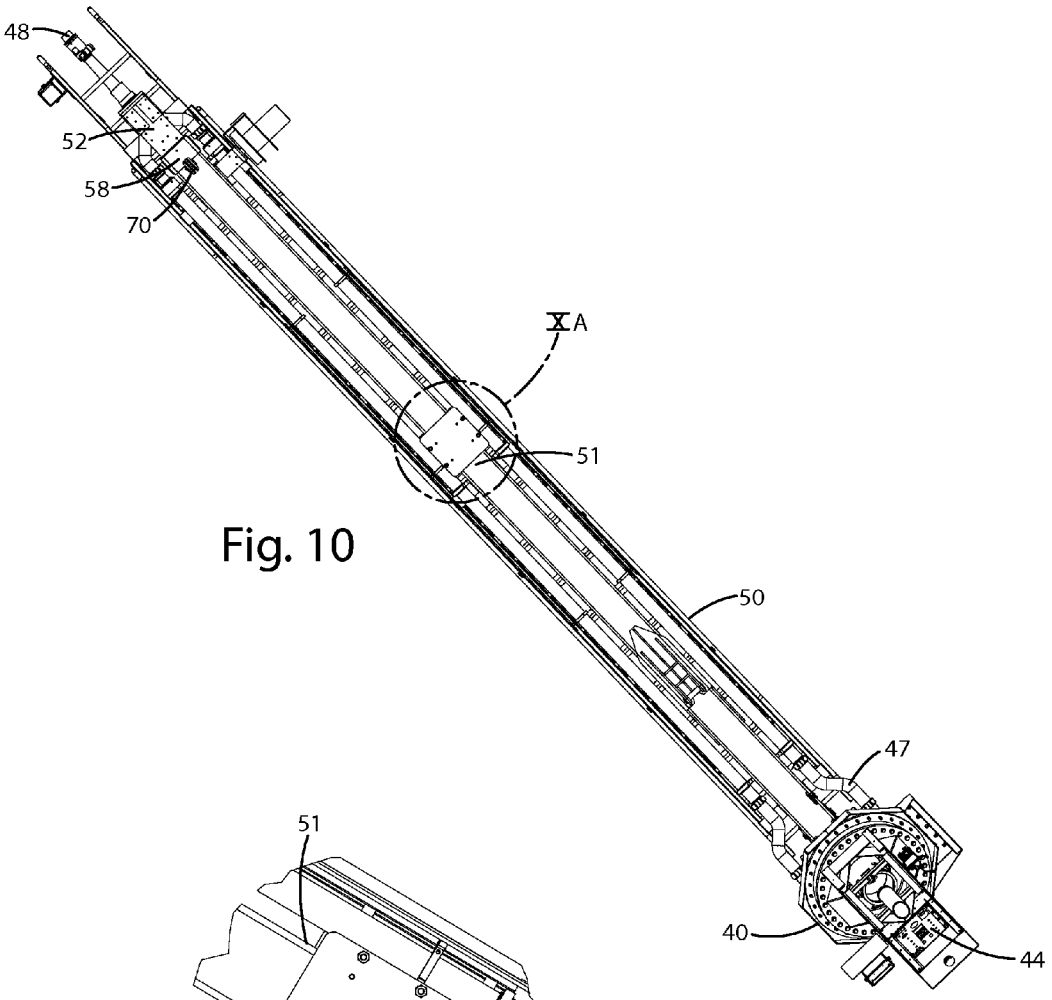
FIG. 10 is a upward-looking view of the underside of the ladder and a mounting plate for the winch.
Figure 10A:
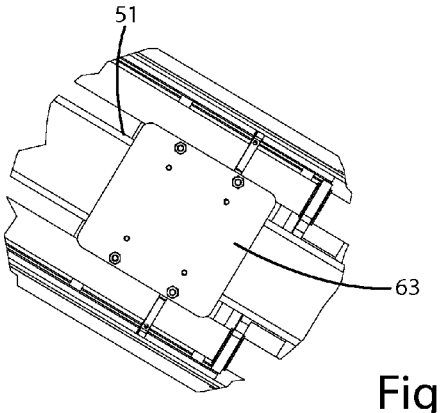
FIG. 10A is a close up of the mounting plate of the winch mounted on to the ladder.

As shown in FIGS. 10 and 11, the base 51 of the ladder can include a box or channel shaped cross-section 51B. With this construction, the base 51 can be substantially reinforced and rigid. Optionally, the base can be constructed from steel and/or other extremely rigid alloys or metal, and further optionally, not constructed from aluminum or other soft metals. The base 51 further can be reinforced with a variety of reinforcing lattice or other structure.

As mentioned above, the base 51 can be in the form of a boom. The lower, first ladder section 51A can be mounted to the base boom 51 in a fixed manner, utilizing first mounting brackets 52M. The base boom 51 also can include a second boom or fly boom 52 telescopingly mounted relative thereto. The second boom 52 can generally extend and retract from the base boom 51. The upper, second ladder section 52A can be mounted to the second boom 52 in a fixed manner, utilizing second mounting brackets 53M.

As shown in FIG. 11, the fly boom 52 can be slidingly mounted inside the base boom 51. Of course, this configuration can be reversed in some applications. Generally, the cross sections of the fly boom and base boom can be identical, but with the dimensions of one smaller than the other so that one boom fits inside the other. Optionally, the cross sections can be polygonal, for example, square or rectangular, so the booms do not rotate relative to one another.

Optionally, the base can include multiple climbing rungs if desired so that it can itself function as a ladder. Again, as shown the rungs can be absent from the base so that the base does not extend but instead the ladder sections 51A and 52A extend relative to one another without the section 51A extending relative to the base boom.

The ladder, base and secondary boom generally include one or more waterways 47 mounted thereto. These waterways are operable to transfer a continuous supply of firefighting fluid to the water outlet 48 which is generally in the form of a nozzle. Generally the waterway receives pressurized firefighting fluid from a pump or storage tank on the frame 30. More particularly, the nozzle 48 assists in pressurizing and/or shaping the continuous stream of firefighting fluid from the waterway 47 toward a fire in a burning building, in a vehicle or elsewhere. Generally, the waterway can include multiple rigid, tubular sections that telescope and slide relative to one another. Optionally, the waterways can become progressively smaller, closer to the water outlet 48.

The waterways 47 can be disposed along and extend the length of the ladder 50. The waterways are maintained in close proximity to (and usually under) the ladder sections 51A and 52A, even as the ladder 50 is moved between extended and retracted positions. The telescoping tubular sections of the waterways can cooperate with one another to provide a continuous fluid passageway along the length of the ladder 50.

As illustrated in FIGS. 1 and 11, the fire truck or frame can include a ladder support 55. When the ladder 50 is in a generally horizontal stored position, the base 51 rests upon the ladder support 55, and optionally a plate or pad 55P mounted atop the support 55. This plate or pad can be of a cushioned or other material, such as rubber and/or Nylatron™ GSM, to absorb vibration and minimize impact between the base 51 and the support 55.

Optionally, the ladder support 55 is mounted directly to the chassis 33B of the frame 30 in a rigid supportive manner. This is so that the immense weight of the ladder 50 can be supported without resting on other structural components of the vehicle, such as the cab 34 or the forward portion 31 of the truck in general. The ladder support 55 supports the ladder 50 and in particular the base 51, so that it is elevated a preselected distance above the cab 34 when the ladder is in the generally horizontal stored position.

Figure 8:
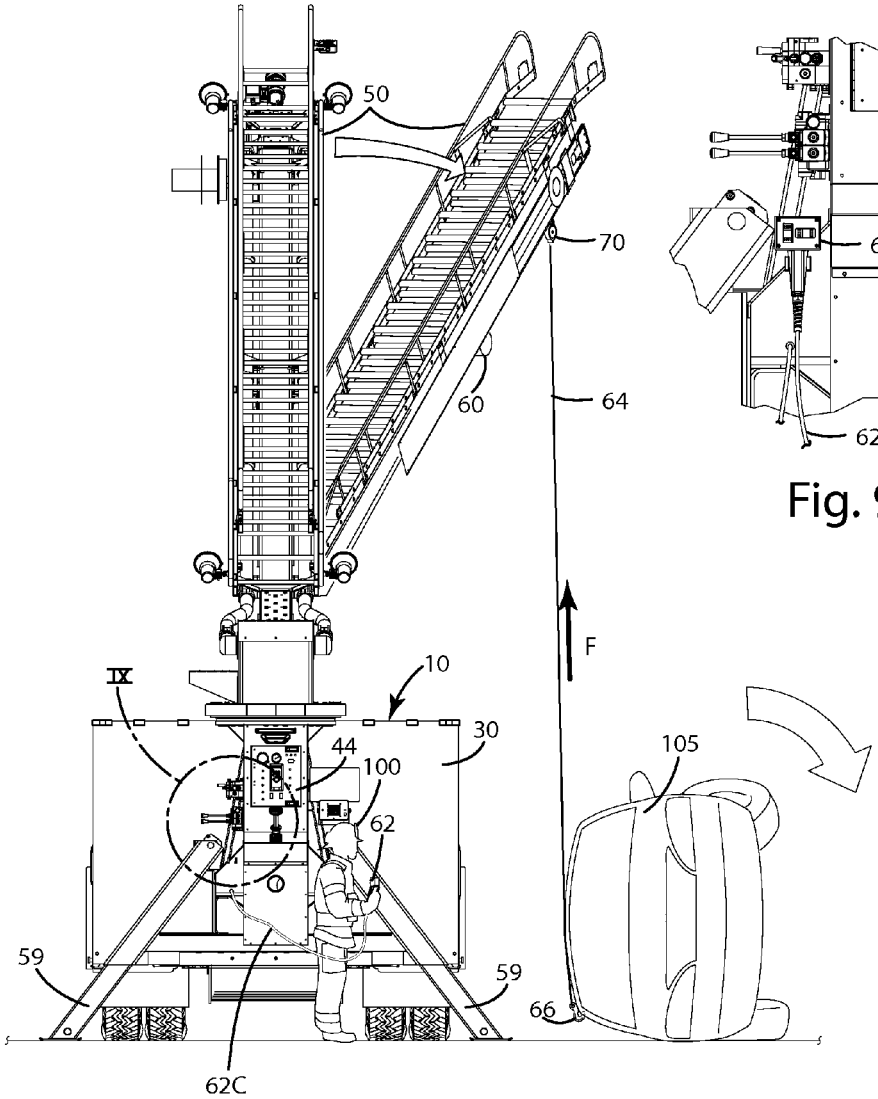
FIG. 8 is a rear view of the firefighting apparatus moving a target object.

As shown in FIG. 8, the fire truck 10 optionally can be outfitted with one or more stabilizer legs 59 that extend outwardly from the rearward portion and/or forward portion of the truck to stabilize the truck and prevent it from tipping when the ladder 50 is extended outward at some predetermined angle $\alpha$ relative to the longitudinal axis LA of the truck. Optionally, the booms can be locked in a safety mode where they cannot extend relative to one another until the stabilizer legs 59 are extended. Of course, some trucks can be configured to allow the booms and/or ladder sections to extend with the stabilizing legs 59 not extended.

As shown in FIGS. 1 and 5-8, a recovery winch 60 is mounted directly on the lower or base 51, which again optionally can be in form a boom as described above. The winch 60 can include a spool upon which a cable 64 is wound. As used herein, a cable can be a multiple metal stranded conventional cable, a chain, a rope, a web, a cord or any other elongated element that can be placed under tension to transfer a force to an object. Generally, the winch 60 is operable so that it can uptake the cable 64 and apply a tension or force via the attachment element 66 to anything to which the attachment element is connected. The winch 60 also is operable to unspool or let out the cable 64 so that the attachment element can be lowered to a desired position.

Figure 9:
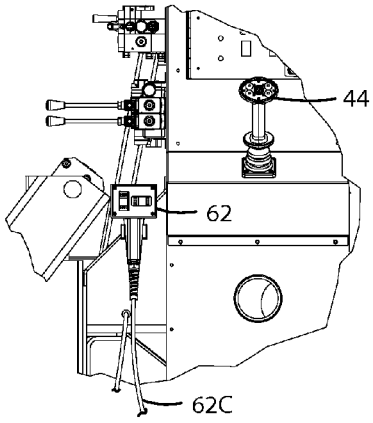
FIG. 9 is a close-up view of a remote control of the winch.

The winch can be an electrically operated winch. In such a case, the winch can be in electrical communication with the fire truck's electrical system. Of course, the winch can be any hydraulic, pneumatic or other winch as desired, depending on the application. Where the winch electrically coupled to the truck's electrical system, the winch can be operated by a controller, which as illustrated is in the form of a remote control 62. The remote control 62 can be mounted on the rearward portion 33 of the truck or frame as shown in FIG. 9. The remote control can be coupled via a tether or cord 62C to the truck or frame so that a user 100 can operate the winch from a location remote from the winch as shown in FIG. 8 and further described below.

The winch can be of a variety of load capacities, which can depend on the application and the configuration of the ladder and/or base. Optionally, the winch can be a 3,000 pound winch commercially available from Warn Industries Inc., of Clackamas, Oreg. Of course, other heavier or lighter winches, for example, 1,000 pound winches or 10,000 pound winches can be substituted therefor, again depending on the particular construction of the ladder or base 51 as well as the applications in which the winch will be utilized.

Returning to FIGS. 5 and 10, the winch 60 can be mounted via a winch mounting plate 63 which is itself mounted to the underside 51U of the base ladder section 51. The winch mounting plate 63 can be fixedly and immovably welded to the bottom of the base 51. The winch 60 can be fastened to the winch mounting plate utilizing bolts, screws or other fasteners With the fasteners, the winch 60 can be removed for service or repair relatively easily. While the winch as illustrated is generally mounted to the underside of the base 51, it alternatively can be mounted on a side of the ladder or base; however, with such mounting, the base can be reinforced to prevent excessive torque and twisting of the base.

The winch 60 also can be mounted distal from the turntable 40 and distal from the upper end 58 of the base 51. Generally, the mounting plate 63 and winch 60 can be mounted about midway between the turntable 40 and the upper end 58 of the base 51. The winch 60 also can be located so that when the ladder is lowered, the winch 60 is situated rearward of the ladder support 55 and also rearward of the cab 34 in the generally horizontal stored position. This configuration is helpful in that the winch is tucked in and under the ladder without interfering or damaging the cab 34 or the rearward portion of the vehicle, and without interfering with the resting or seating of the ladder on the support 55.

As shown in FIG. 5, the winch 60 can include a cable 64 extending therefrom. When operational, the cable 64 can extend along the base 51 toward a pulley 70. The pulley 70 can be mounted to the upper end 58 of the fly boom 52 of the ladder 50. This is so that the full length of the base or boom 51 can be utilized, without putting excessive forces on the other ladder sections or an extended fly boom. Optionally, the pulley 70 can be placed on the far upper end of the fly boom 52. The winch and boom status can be cooperatively monitored by a controller in the control console 44. The controller can restrict operation of the winch depending on the extension of the fly boom relative to the base boom. For example, the controller can prevent operation of the winch when the fly boom is extended a preselected amount (or any amount) relative to the base boom. Further optionally, in some applications, the pulley can be detachably mounted to the distal end of the base boom if desired.

The cable 64 can extend over and wrap at least partially around the pulley 70. As shown in FIG. 5, the cable 64 generally extends downwardly vertically, and can terminate at an attachment element 66. As shown, the attachment element 66 can be in the form of a hook. Of course other attachment elements such as clamps, tongs or other devices can be substituted for the hook 66.

Figure 6:
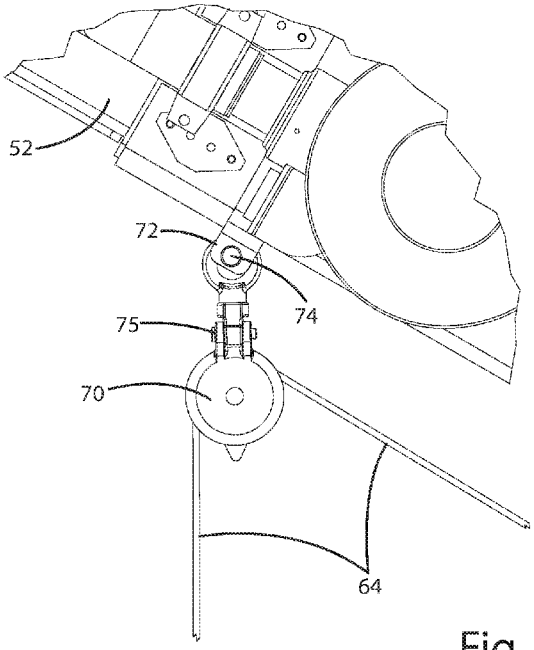
FIG. 6 is a close-up view of the pulley taken from view IV in FIG. 5.
Figure 7:
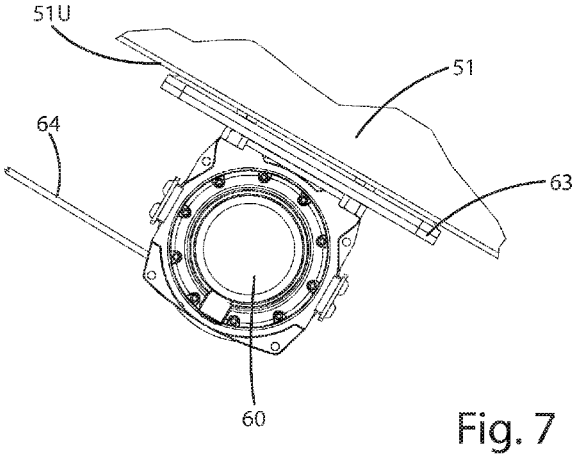
FIG. 7 is a close-up view of the winch taken from view VII in FIG. 5.

Referring to FIG. 6, the pulley 70 can be mounted to a pulley bracket 72 via a pin 74. Optionally, the pin 74 can be selectively removable so that the pulley 70 can be removed from the pulley bracket 72, and generally the fly boom 52 or ladder 50 for storage. The pulley bracket 72 can be fixedly welded to the boom at the second or upper end of the fly boom 52. The pulley also can include a swivel mechanism 75 to allow lateral or other angle orientations of the pulley 70 during operation if desired.

Figure 12:
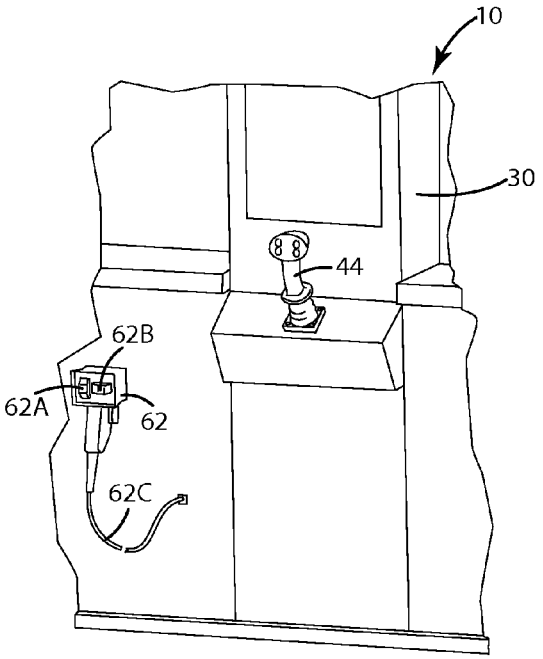
FIG. 12 is a close-up view of a remote control of the winch.

As shown in FIGS. 5 and 12, the winch can be operatively connected to a remote control 62. The remote control 62 can be operatively connected to the winch via a cord 62C. This cord 62C can be of a sufficient length, for example, at least 10 feet, 20 feet, 30 feet, 40 feet or 50 feet, and can be selectively retractable or so that a user of the winch can hold the remote control and manually operate it while viewing the attachment element 66, cable 64 and/or a target object 105 to which the same is attached for movement by the winch 60.

Although shown with a cord 62C, the remote control 62 can be outfitted with a wireless transmitter and/or receiver that can cooperatively send and receive signals to and from the winch 60 to thereby operate the winch. Of course, in some applications an untethered remote control 62 might be disadvantageous in that it can lead to a loss of the remote control. For this reason, the cord 62C is usually included in the system. Where the cord is not included the remote control can operate and communicate with the winch wirelessly, utilizing radio frequency, infrared, cellular or other communication modes.

As shown in FIG. 12, the remote control 62 can include first and second buttons, switches or manual controls 62A and 62B. The first control 62A can generally arm the remote control 62 so that it can operate the winch 60. If desired, this control 62A can be operable in a locked mode and an unlocked mode. In the locked mode, the winch is generally inoperable and unable to uptake or let out the cable. The locked mode can be automatically attained when the ladder 50 is outside a predetermined angle range or orientation. For example, control of the winch can be locked out of operation when the ladder 50 is at an improper vertical angle B (FIG. 5), which can be an angle of greater than about 50 degrees, 60 degrees, 70 degrees, 80 degrees or 90 degrees, depending on the construction of the ladder and the winch. As another example, the winch can be automatically locked out of operation when the ladder 50 is at an improper rotation angle $\alpha$ relative to the longitudinal axis of the truck, which can be an angle of greater than about 80 degrees or about 90 degrees, or some other angle depending on the construction of the ladder and the winch, as well as the configuration of the stabilizer legs 59. With regard to the latter, the remote control and winch can go into the locked mode automatically if the stabilizer legs 59 are not sufficiently deployed from the frame 30. As a further example, the winch can go into the locked mode when one or more upper ladder sections above the base are extended. Optionally, when the locked mode is attained, at least one of an audio and visual alarm can be actuated to alert the operator of the locked status.

Optionally, the locked mode can be overridden by manual operation of the control 62A in certain circumstances. In some uses, the control 62A can simply be a switch. An operator can move the switch from the locked mode to another position corresponding to the unlocked mode. The other control 62B can generally operate the uptake and let out of the cable 64 relative to the winch. Additional controls may be included on the remote control 62 as desired.

Operation of the aerial firefighting or rescue apparatus of the current embodiments will now be described. The firefighting apparatus 10, optionally in the form of an aerial fire truck, can be used to fight fires in a building or other structure. In some circumstances, however, the truck 10 may be dispatched to and arrive at an emergency location where access to an elevated position is unneeded. In this case, the ladder 10 can double as a crane or boom to move, lift, upright or otherwise manipulate target objects.

As illustrated in FIG. 8, the fire truck can be driven to the emergency location and parked in the vicinity of the target object 105. There, the target object is illustrated as a vehicle that is overturned on its side. Occupants may be trapped within the vehicle 105, and the only way to provide access to the vehicle is to turn the vehicle over. In such a case, an operator first operates the ladder using the ladder controls 44. Generally in transport, the ladder is in the horizontal stored position as shown in FIGS. 1 and 11. At the emergency location, where a target object is to be moved, the ladder is horizontally lifted using the raising and lowering mechanism 46. The ladder also can be pivoted or rotated with the turntable 40 so that it is at an angle relative to the longitudinal axis LA of the vehicle as shown in FIG. 8, or otherwise extends beyond the sides or rear of the truck 10.

Optionally, before the ladder is raised to the position shown in FIG. 5 or 8, the pulley 70 can be installed on the fly boom 52 at the second or upper end 58 by installing the pin in the pulley bracket 72. The cable 64 can be threaded through the pulley 70 and supported thereby. The cable 64 can be let out from the winch 60 using the remote control 62 operated by user 100. The cable attachment element 66 at the end of the cable can be attached to the target object 105 in a satisfactory location.

After the attachment element 66 is satisfactorily attached to the target object to achieve the desired movement, the user 100 can operate the remote control 62 to operate the winch. Generally, the controls can be manually manipulated to uptake the cable 64 with the winch 60. This in turn results in a force F in the form of a tension within the cable 64. The force F is transferred to the target object 105 via the attachment element, as illustrated a hook 66. Upon sufficient application of the force F the target object can be up-righted as shown in the direction of the arrow.

As mentioned above, the remote control 62 can be tethered via a cord 62C to the frame 30 and in an electrical communication with the winch 60. The cord 62C can be of a sufficient length so that the user 100 can manually operate the remote control 62 while in direct view of the target object 105. This can enable the user 100 to make fine adjustments to and monitor the progress of the application of force F via the cable 64.

After the target object is up-righted or otherwise moved, the attachment element 66 can be disconnected from it. And after all target objects at a particular emergency location are moved using the ladder mounted recovery winch 60, the pulley 70 can be removed and the winch spooled to uptake the cable 64. The ladder can then be moved from its raised position to the generally horizontal stored position as shown in FIGS. 1 and 11. The firefighting apparatus then can be transported back to its garage or station.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An aerial firefighting apparatus, comprising:

a frame configured to enable transportation of the apparatus to an emergency location, the frame including a forward portion, a rearward portion, a first side and a second side opposite the first side;

a ladder that is both extendible and retractable, the ladder comprising a base boom, and a fly boom retractably and extendably joined with the base boom, and at least one upper ladder section movably joined with the base boom so that the upper ladder section can be extended and retracted relative to the base boom to provide extension and retraction of the ladder, the ladder being movably mounted relative to the frame so that the ladder can be raised from a generally horizontal stored position to a raised position wherein the ladder extends upwardly at an angle from the frame;

a turntable to which the ladder is mounted, the turntable being configured to selectively rotate so that the base boom can be swung to a plurality of positions;

a winch mounted to and adjacent the base boom distal from the turntable so that the winch moves along with the base boom when the base boom moves, the winch including a spooled supply of cable having an attachment element located at an end of the cable;

a pulley mounted adjacent a distal end of the fly boom and spaced a distance from an upper end of the ladder so that the pulley is moveable toward and away from the base boom, on the fly boom, and so that when the ladder is in the raised position the pulley is above the winch;

a remote control being remote from the winch but operably connected to the winch for operation of the winch, a stabilizer leg configured to stabilize the aerial firefighting apparatus, wherein the remote control is configurable in a locked mode and an unlocked mode, wherein the locked mode is automatically attained when at least one of: the ladder is at an angle greater than a predetermined angle, the ladder is rotated at an angle relative to a longitudinal axis of the frame greater than a predetermined rotation angle, the stabilizer leg is not sufficiently deployed, and the fly boom is extended greater than a predetermined amount, wherein the attachment element is adapted to join the cable with a target object located adjacent the frame, wherein the remote control is operable by a user remotely from the winch to uptake the cable relative to the winch and thereby configured to exert a force on the target object to which the attachment element is attached, whereby the target object can be at least one of lifted and moved with the winch mounted on the underside of the base boom.

2. The aerial firefighting apparatus of claim 1 wherein the remote control is coupled to at least one of the frame and the winch with a cord of a length that enables the user to operate the remote control while in plain view of the target object.

3. The aerial firefighting apparatus of claim 2 wherein the cable does not extend beyond the upper end of the ladder.

4. The aerial firefighting apparatus of claim 1, wherein the pulley is mounted to the fly boom below the upper end of the ladder, wherein the winch is below the pulley and below the distal end of the fly boom when the ladder is in the raised position.

5. The aerial firefighting apparatus of claim 1 comprising a cab and a ladder support, the ladder support extending upwardly from the frame and adapted to support the ladder when the ladder is in the generally horizontal stored mode, wherein the winch is mounted to the base boom in a location so that when the ladder is in the generally horizontal stored mode, the winch is rearward of the cab.

6. The aerial firefighting apparatus of claim 1 comprising a tank adapted to store firefighting fluid and a pump adapted to pressurize the firefighting fluid and transport it to a waterway joined with the ladder.

7. An aerial firefighting apparatus, comprising:

a mobile frame including a forward portion, a rearward portion, a rear axle located in the rearward portion, a first side and a second side opposite the first side;

a ladder movably mounted relative to the frame so that the ladder can be raised from a generally horizontal stored position to a raised position wherein the ladder extends upwardly at an angle from the frame, the ladder comprising a base boom and a fly boom retractably and extendably joined with the base boom;

a turntable to which the ladder is mounted, the turntable being mounted rearward of the rear axle, the turntable being configured to selectively rotate so that the ladder can be swung to a plurality of positions;

a winch mounted adjacent the base boom distal from the turntable so that the winch moves along with the base boom when the base boom moves, the winch including a spooled supply of cable having an attachment element located at an end of the cable;

a pulley detachably mounted adjacent a distal end of the fly boom and spaced a distance from an upper end of the ladder, the pulley being moveable toward and away from the base boom, the pulley being distal from the winch so that when the ladder is in the raised position the pulley is above the winch; and a control connected to the winch for operation of the winch, a stabilizer leg configured to stabilize the aerial firefighting apparatus, wherein the control is configurable in a locked mode and an unlocked mode, wherein the locked mode is automatically attained when at least one of: the ladder is at an angle greater than a predetermined angle, the ladder is rotated at an angle relative to a longitudinal axis of the frame greater than a predetermined rotation angle, the stabilizer leg is not sufficiently deployed, and the fly boom is extended greater than a predetermined amount, wherein the attachment element is adapted to join the cable with a target object located adjacent the frame, but separate from the apparatus;

wherein the control is operable by a user to move the cable and thereby configured to exert a force on the target object to which the attachment element is attached, whereby the target object can be at least one of lifted and moved with the winch.

8. The aerial firefighting apparatus of claim 7 wherein the control is remotely located from the winch, wherein the control includes a cord coupled to at least one of the frame and the winch and of a length that enables the user to operate the control while in plain view of the target object.

9. The aerial firefighting apparatus of claim 7 comprising a mounting plate joined with the ladder, wherein the winch is mounted to the mounting plate.

10. The aerial firefighting apparatus of claim 9 comprising a cab, wherein the mounting plate is mounted to the boom in a location so that when the ladder is in the generally horizontal stored mode, the winch is rearward of the cab.

* * * * *